US005396255A

United States Patent [19]

Durkota et al.

[11] Patent Number: 5,396,255

[45] Date of Patent: Mar. 7, 1995

[54] AUTOMATED FAR FIELD ANTENNA PATTERN TEST FACILITY

[75] Inventors: Alan E. Durkota; Robert E. Botsford, both of Stratford; Joseph J. Kotomski, Jr., Naugatuck, all of Conn.

[73] Assignee: United Technologies Corporation, Hartford, Conn.

[21] Appl. No.: 203,180

[22] Filed: Feb. 28, 1994

[51] Int. Cl.[6] ..... H01Q 3/00

[52] U.S. Cl. ..... 342/360; 342/173

[58] Field of Search ..... 342/360, 173, 174; 343/703

[56] References Cited

U.S. PATENT DOCUMENTS

| | | | |
|---|---|---|---|
| 4,673,939 | 6/1987 | Forrest | 342/174 |
| 4,754,496 | 6/1988 | Fishkin et al. | 455/67 |
| 4,884,078 | 11/1989 | Fishkin et al. | 342/360 |
| 5,039,991 | 8/1991 | Boese et al. | 342/420 |
| 5,163,176 | 11/1992 | Flumerfelt et al. | 342/174 |

*Primary Examiner*—Theodore M. Blum
*Attorney, Agent, or Firm*—Michael Grillo

[57] ABSTRACT

An antenna test and measurement system (100) performs measurements of the transmitted or received signal strength of a vehicle mounted transmit or receive antenna (102) with respect to all aspects of the system with respect to the vehicle mounted antenna, and vehicle state parameters (131, 139), i.e., position and attitude, are simultaneously recorded (185, 186). The antenna measurements are correlated with the state parameter measurements such that variations in the measured signal strength caused by changes in vehicle state are apparent. A graphical display (189, 190) of antenna signal strength and vehicle state parameters are presented for the entire 360° azimuth of an antenna test so that variations in the signal strength caused by changes in vehicle state parameters may be identified. The graphical display of antenna signal strength may be modified based on variations in vehicle state parameters such that the graphical display indicates the antenna signal strength had the variations in vehicle state not occurred. Antenna signal strength data and vehicle state information is telemetered (122, 171, 175, 178, 181) from the vehicle carrying the antenna to the antenna test and measurement system. A graphical display of antenna signal strength versus antenna altitude (FIGS. 5 and 7) is provided for determining the optimum altitude for antenna pattern measurements, and calculation of antenna isotropic (FIG. 10) is provided for verification of antenna performance.

12 Claims, 10 Drawing Sheets

AUTOMATED FAR FIELD ANTENNA PATTERN TEST FACILITY

TECHNICAL FIELD

The present invention relates to antenna test and measurement systems, and more particularly to a mobile, automatic antenna test and measurement system which provides the capability of measuring antenna patterns of both transmit and receive antennas, the measurements being compensated for in real time for changes in the orientation and position of a platform carrying the antenna, which changes may affect antenna test measurements.

BACKGROUND OF THE INVENTION

Various vehicles including land born, airborne and waterborne vehicles are provided with a plurality of antennas for both the transmission and receipt of radio frequency (RF) electro-magnetic transmissions for a variety of purposes. For example, antennas are provided for the receipt of RF transmissions for use in direction finding (DF). In such DF applications, RF transmissions from a signal source are received by the antenna and processed by a receiver and processor for phase and amplitude signature recognition to determine the "direction of the source". Similarly, various transmit antennas are provided for the transmission of RF signals for communication purposes.

A problem associated with the use of antennas on vehicles is that appendages on the vehicle may interfere with the transmit or receipt of RF signals by the antenna. Such interfering appendages include other antennas, armaments, aircraft landing gear, a ship superstructure, etc. In the case of a transmit antenna, these interfering objects may seriously degrade the transmission of RF signals in certain directions relative to the antenna. Therefore, steps are typically taken to test the output transmission at various locations with respect to the antenna after installation on the vehicle to verify that signal transmission is satisfactory in all directions and action is taken to correct an unsatisfactory condition. Similarly, with respect to a receiving antenna, and most particularly a DF antenna, appendages may obstruct or redirect received RF signals such that the receiving antenna does not receive the RF transmission or if it does receive the RF transmission, the indicated direction will be inaccurate because of reflection and redirection.

Even when antennas are installed in optimal position, new antenna installations are typically tested to ensure that the antenna has been properly installed and a signal path is provided between the antenna and the transmitting or receiving equipment on the vehicle.

Another problem associated with the testing of vehicle mounted antennas is that vehicle motion may be indicated as a change in the transmission or receipt of RF energy by the antenna and therefore be improperly interpreted as a problem with the transmission or receipt of RF energy by the antenna. For example, helicopters tend to drift in position when performing a hover turn for antenna pattern measurement. This drift introduces errors into the antenna pattern measurement. These errors would make it extremely difficult to test at night or during other reduced visibility conditions, e.g., fog, rain, etc., because pilots do not have a good visual reference point for the minimization of helicopter drift. Additionally, environmental conditions may cause changes in the position of the test platform. For example, a shift in the wind may cause a change in the position or attitude of a helicopter.

SUMMARY OF THE INVENTION

Objects of the invention include the provision of an antenna test and measurement system for testing an antenna mounted on a vehicle, the system providing for antenna pattern measurements and the simultaneous measurement of changes in vehicle position and attitude, e.g., roll, pitch, yaw, which can affect antenna test measurements.

Another object of the present invention is to provide an automatic antenna test and measurement system for testing a vehicle mounted antenna which records, displays and analyzes vehicle state information and antenna pattern measurements.

A further object of the present invention is to provide a mobile, self contained antenna test and measurement system which allows the testing of an antenna pattern without a fixed test location.

A still further object of the present invention is to provide an antenna test and measurement system which automatically compensates antenna measurements for changes in vehicle position and attitude.

Another object of the present invention is to provide an automatic antenna test and measurement system which, when testing an antenna mounted on an airborne vehicle, provides for an altitude search for determining the optimum altitude for antenna pattern measurements, and which provides for the calculation of antenna isotropic measurements for comparing the test antennas performance to theoretical performance criteria.

According to the present invention, an antenna test and measurement system performs measurements of the transmitted or received signal strength of a vehicle mounted transmit or receive antenna with respect to all aspects of the system with respect to the vehicle is mounted antenna, and vehicle state parameters, i.e., position and attitude, are simultaneously recorded. The antenna measurements are correlated with the state parameter measurements such that variations in the measured signal strength caused by changes in vehicle state are apparent.

In further accord with the present invention a graphical display of antenna signal strength and vehicle state parameters are presented for the entire 360° azimuth of an antenna test, or any portion thereof, the signal strength display providing an indication of antenna performance throughout the 360° azimuth, and the state parameters being correlated with the signal strength display so that variations in the signal strength caused by changes in vehicle state parameters may be identified. In still further accord with the present invention a graphical display of antenna signal strength is provided wherein received signal strength is modified based on variations in vehicle state parameters such that the graphical display indicates the antenna signal strength had the variations in vehicle state not occurred.

In still further accord with the present invention, antenna signal strength data and vehicle state information is telemetered from the vehicle carrying the antenna to the antenna test and measurement system. According further to the present invention, duplex telemetering may be provided between the antenna test and measurement system and the vehicle carrying the antenna such that antenna test and measurement may be performed without an antenna operator on the vehicle.

According still further to the present invention, a graphical display of antenna signal strength versus antenna altitude is provided for determining the optimum altitude for antenna pattern measurements, and calculation of antenna isotropic is provided for verification of antenna performance The present invention provides a significant improvement over the prior art because rapid and accurate antenna measurements may be performed from a mobile antenna test and measurement system. The system provides for the identification Of variations in the received antenna signal strength caused by changes in vehicle state parameters. Therefore, if a variation in antenna signal strength is identified at a particular azimuth location, the test operator can first check if the variation was caused by a change in vehicle state conditions prior to requiring the test to be repeated to verify antenna performance. This provides the further advantages of reducing flight time and therefore significantly reducing the cost of performing the test. By providing a mobile test site, the requirement for a fixed test location is eliminated thereby reducing the expense of maintaining a fixed antenna test site. Additionally, if a duplex telemetry system is used, controlled from the mobile antenna test and measurement unit on the ground, the requirement for onboard antenna test personnel is eliminated, further reducing the cost associated with performing antenna measurements. The recorded test data may be used for further analysis and for display in a variety of formats.

The foregoing and other objects, features and advantages of the present invention will become more apparent in the following detailed description of exemplary embodiments thereof, as illustrated in the accompanying drawings.

BEST MODE FOR CARRYING OUT THE INVENTION

The antenna test and measurement system of the present invention is particularly well suited for providing rapid and accurate antenna test data indicative of the performance of vehicle mounted transmit and receive antennas. The system may be used to record, display and analyze vehicle state information in addition to antenna pattern measurements such that variations in the antenna pattern caused by changes in vehicle state are apparent. Additionally, the system may be implemented using duplex telemetry such that data and control signals may be transmitted between the vehicle and the test and measurement system so that an antenna test operator is not required on the vehicle. The invention significantly reduces the cost associated with performing antenna testing because variations in measured antenna signal strength caused by changes in vehicle state may be immediately identified so that measurements may be either immediately retaken or the requirement for additional measurements may be reduced or eliminated.

The system of the present invention will be described in context of testing a transmit antenna mounted on a helicopter. However, it will be understood by those skilled in the art that the antenna test and measurement system is equally useful for performing tests and measurements of both transmit and receive antennas mounted on a variety of vehicles such as ships, fixed wing aircraft and motor vehicles.

Figure 1:
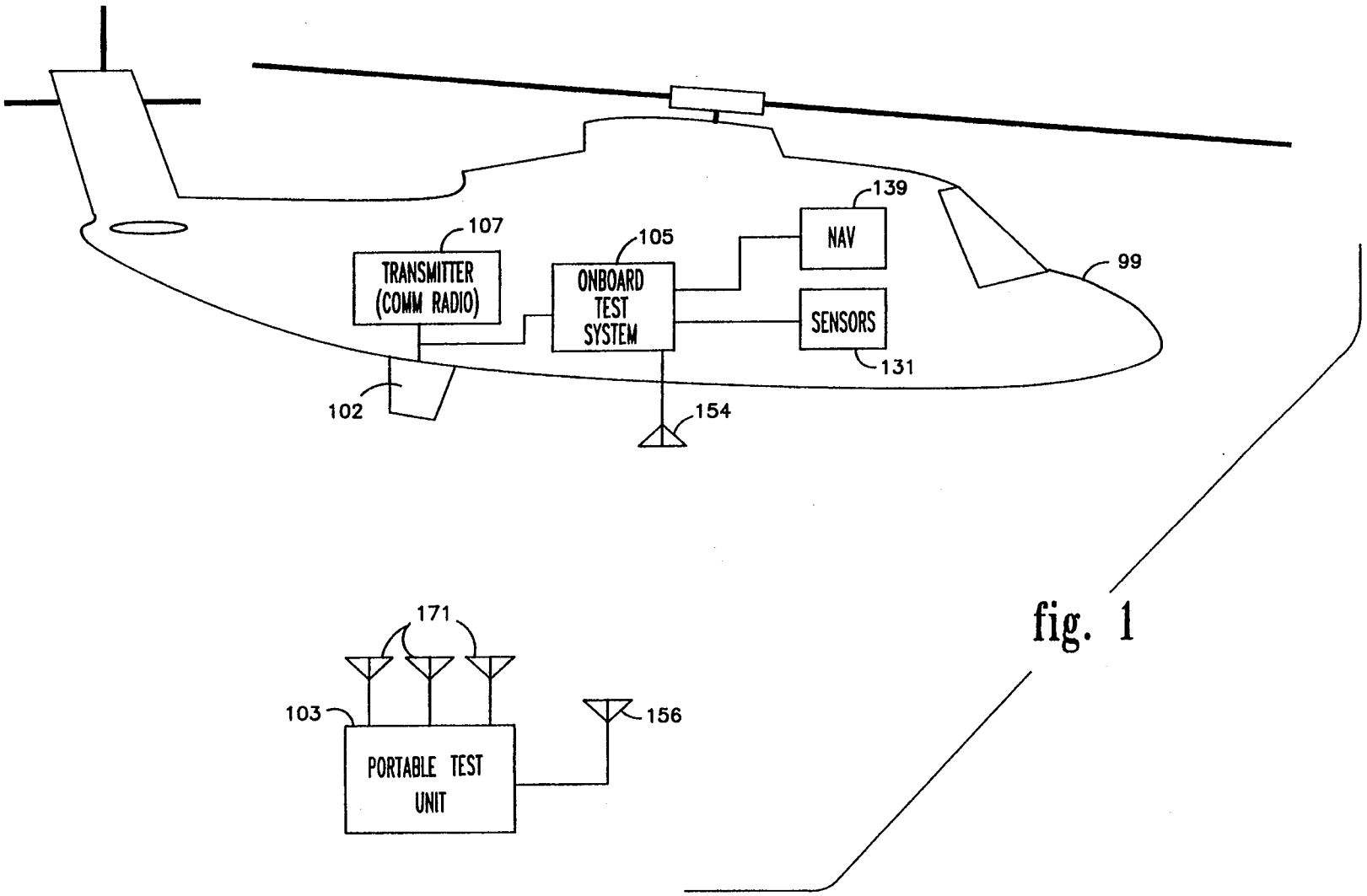
FIG. 1 is a schematic block diagram of the antenna test and measurement system of the present invention configured for testing a test antenna mounted on a helicopter.
Figure 2:
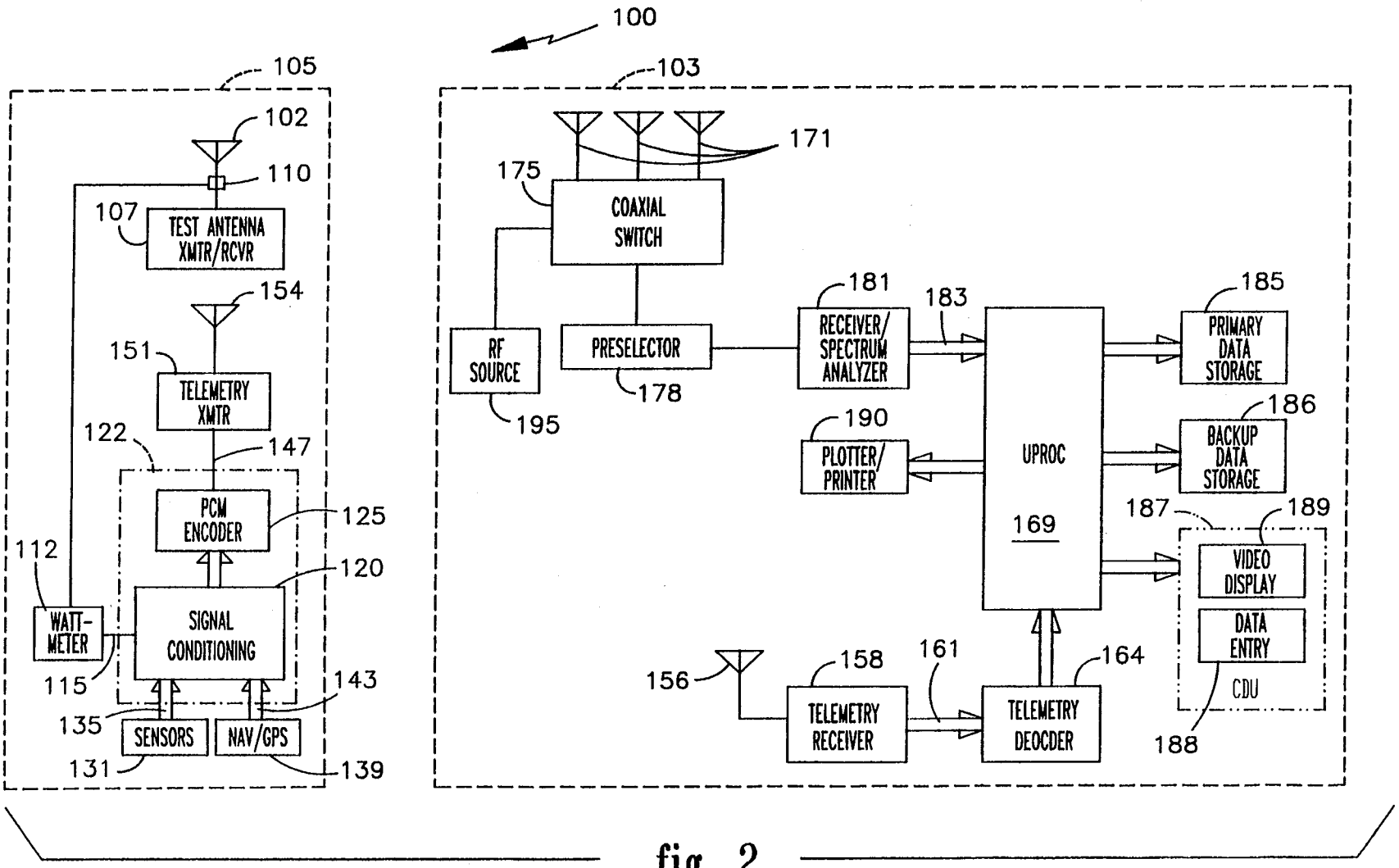
FIG. 2 is a more detailed schematic block diagram of the antenna test and measurement system of FIG. 1.

Referring to FIGS. 1 and 2, the antenna test measurement system 100 of the present invention is shown configured for testing a transmit antenna (test antenna) 102 mounted on a helicopter 99. The antenna test and measurement system 100 comprises a portable test section 103 and a vehicle mounted test section 105. The test antenna 102 is connected to a transmitter or receiver 107 located on the aircraft, and provides a path for either the transmit or receipt of RF signals, respectively. A watt meter element 110 and watt meter 112 are used to provide local measurements of the transmitted power of the test antenna 102. Signals indicative of the transmitted power level are provided by the watt meter 112 on a line 115 to a signal conditioning portion 120 of a pulse code modulator (PCM) 122. The signal conditioning portion 120 of the PCM 122 conditions the analog signals provided by the watt meter 112 so that they may be converted into digital signals by an encoder portion 125 of the PCM 122, as will be described in greater detail herein after with respect to FIG. 3.

The PCM 122 is also responsive to signals provided by aircraft sensors 131 on signal lines 135 for receiving signals indicative of aircraft pitch, roll, and altitude. Additionally, the PCM 122 receives signals provided by the aircraft navigational system (global positioning system) 139 on signal lines 143 indicative of the aircraft magnetic heading and aircraft position. The signal conditioning portion 120 of the PCM 122 conditions the analog signals provided by the watt meter, the sensors, and the navigation system, so that these analog signals may be converted to digital signals by the encoder portion 125 of the PCM. The output of the encoder portion 125 of the PCM 122 are digital signals on a line 147 and are provided to a telemetry transmitter 151. The telemetry transmitter 151 amplifies the digital signals and transmits the signals via a telemetry antenna 154.

The RF signals transmitted by the telemetry antenna 154 are received by a telemetry antenna 156 on the portable test section 103 of the antenna test and measurement system 100. The signals received by the telemetry antenna 156 are provided to a telemetry receiver 158 which detects and amplifies the received RF signals. Thereafter, the receiver provides the received RF signals on signal lines 161 to a telemetry decoder 164 wherein the signals are decoded. The output of the telemetry decoder 164 is provided on signal lines 166 to a microprocessor (UPROC) 169. The UPROC may be of any suitable type known in the art such as a Hewlett Packard Model No. 382.

At the same time that the telemetry signals are received by the telemetry antenna 156, one of a plurality of record antennas 171 receives the signals transmitted by the test antenna 102. A plurality of record antennas 171 are provided so that the system may be used for a wide range of antenna frequencies, each record antenna corresponding to a portion of the frequency spectrum. One of the record antennas 171 is selected to receive the signals provided the test antenna 102 by a coaxial switch 175.

The output of the coaxial switch 175 is provided to a preselector 178 which amplifies the received signals and also acts as a band pass filter to pass the desired received frequencies and filter out other noise and undesired signals. Next, the output of the preselector 178 is provided to a receiver/spectrum analyzer 181 which is used to provide an indication of the amplitude of the received signals over the frequency range. The output of the spectrum analyzer is provided on lines 183 to the UPROC 169.

The data received from both the telemetry decoder 164 and the spectrum analyzer 181 by the UPROC 169 is time sequenced and correlated so that variations in antenna received power levels can be correlated with variations in helicopter state conditions as indicated by the telemetry data. The data received by the UPROC is provided to a primary data storage device 185 and a back-up data storage device 186. The data storage devices may be magnetic disks or magnetic tapes, CDROM, or any other suitable type of data storage media for storing the digital signals provided by the UPROC. A control and display unit (CDU) 187 is provided so that an operator may control the antenna test and measurement system. The CDU 187 comprises a data entry device 188 such as a key board or touch pad, and a display 189 such as a video display, e.g., CRT, liquid crystal display, etc. The data entry device 188 allows the test operator to control the operation of the test system, and the display 189 allows the test operator to monitor the test parameters and test results. Additionally, a plotter (printer) 190 may be used to provide printed reports of received antenna signal strength and corresponding telemetry data so that the antenna test and measurement data may be further analyzed as the test is being performed or subsequently. At the completion of the test, the recorded data may be played back for analysis using the UPROC, CDU and printer.

Figure 3:
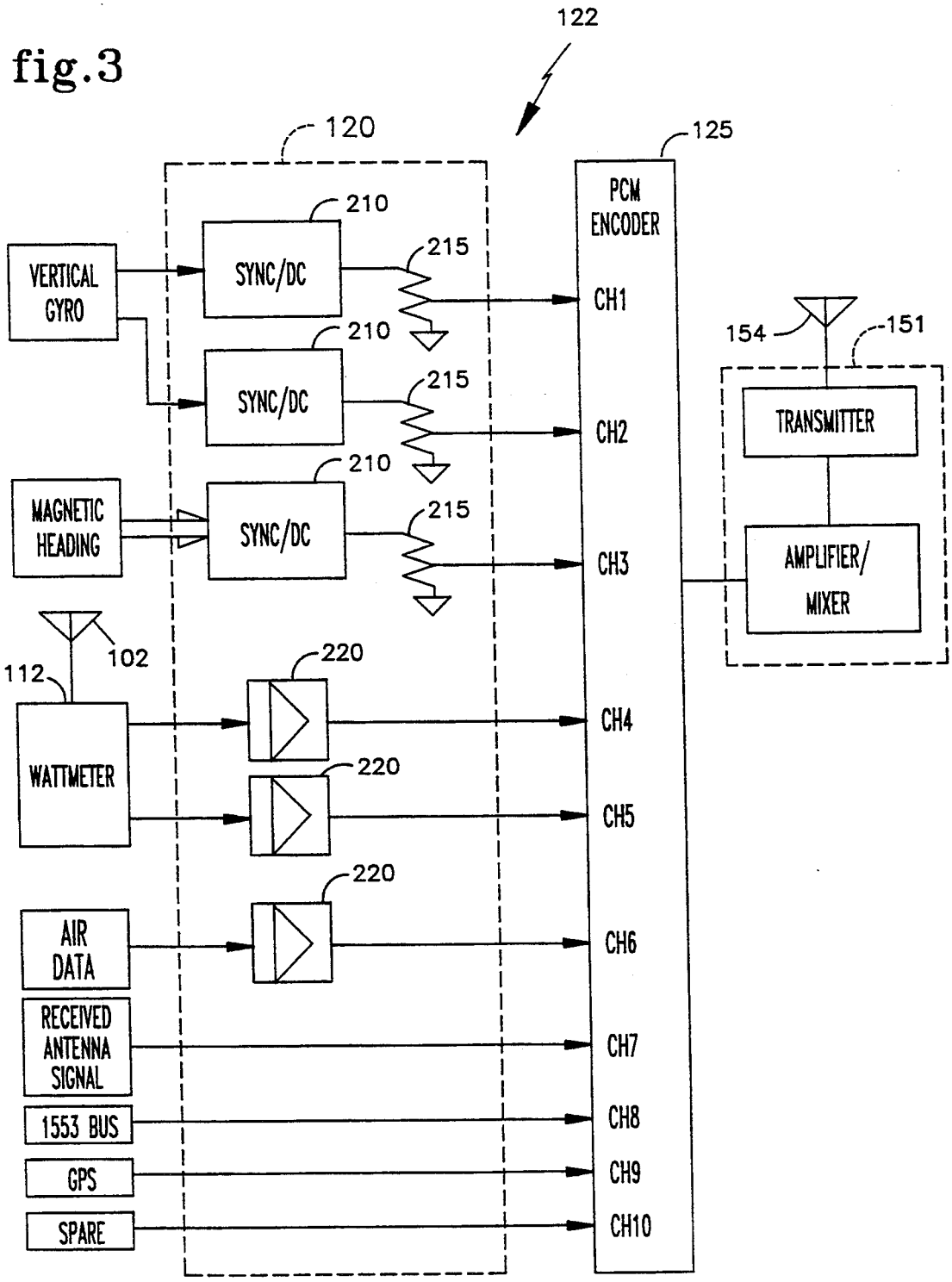
FIG. 3 is a schematic block diagram of the telemetry system utilized by the antenna test and measurement system of FIG. 1.

Referring to FIG. 3, a more detailed drawing of the PCM 122 is provided. As described herein before, the PCM converts aircraft position and attitude signals into digital signals for transmission via the telemetry antenna 154. The signal conditioning portion 120 of the PCM comprises circuitry for conditioning the analog signals so that they may be converted into digital signals by the encoder portion 125 of the PCM. In the example of FIG. 3, the encoder portion is responsive to analog signals having a magnitude between ±2.5 volts. Therefore, the signal conditioning circuitry conditions the input signals to fall in a ±2.5 volt range.

In the example of FIG. 3, the signal conditioning circuitry utilizes synchronous to DC converters 210 and potentiometers for conditioning the pitch, roll and ship's magnetic heading signals. Amplifiers 220 are utilized to condition the output of the watt meter and the altitude signal. The other signals require no signal conditioning prior to being provided to the PCM encoder 125.

It will be understood by those skilled in the art that the foregoing example of FIG. 3 is exemplary, and any other suitable method and apparatus of digitizing analog signals prior to transmission may be used with the system of the present invention. Alternatively, although it is not the preferred method, the analog signals may be telemetered to the ground.

The test and measurement system of the present invention has been described thus far as testing a transmit antenna Wherein the test signals transmitted by the test antenna are provided by the antenna's own transmitter. However, it will be understood by those skilled in the art that an RF signal source may be used to substitute the antenna's own transmitter for providing the test signals. Additionally, it will be understood by those skilled in the art that an antenna intended solely for the receipt of RF signals may be tested by injecting RF signals into the antenna and measuring the antenna pattern using the system described thus far. In this case, precautions must be taken so that the power of the signals injected into the test antenna do not exceed a power level which may cause damage to the test antenna. Alternatively, an antenna intended only for receive operation may be tested by providing the portable test section 103 of the system 100 with an RF signal source 195 which may be used to provide RF signals to be transmitted by one of the record antennas 171 via the coaxial switch 175. Thereafter, the transmitted signals would be received by the test antenna 102, and the received RF energy may be measured by a receiver which provides a scaled output (in place of a watt meter element) feeding the PCM 122. In this case, all information related to the test antenna pattern is provided to the UPROC 169 using the telemetry equipment.

The system of the present invention may be used to perform several tests on an antenna. The initial test typically performed is an Altitude Search. During an Altitude Search, the aircraft maintains a fixed aspect, e.g., 0° relative, to the portable test section 103 and transmits via the test antenna on the test frequency while ascending from the lowest safe altitude to a maximum altitude. The signals and information of interest during an Altitude Search are the signal strength (forward power) transmitted by the test antenna and received by the portable test unit, and aircraft altitude. The purpose of the Altitude Search is to determine the changes in transmitted signal strength with respect to altitude. The transmitted signal strength may vary at certain altitudes because of interference and canceling caused by directly transmitted signals and signals which bounce off the earth.

Once the Altitude Search is complete, the test operators may select an altitude to perform an Antenna Pattern Test wherein small changes in altitude will have a minimal effect on the test. Although the Antenna Pattern Test is performed at a hover, variations in environmental conditions may cause changes in the aircraft altitude while performing the test. By selecting an optimum altitude based on the Altitude Search, the effects of the variations in aircraft altitude during the Antenna Pattern Test may be minimized.

The UPROC is provided with interactive subroutines of the type shown in FIGS. 4 through 10 for performing antenna testing in accordance with the present invention. The routines request the test operator to supply information and select various tests and configurations related to the type of testing or playback desired. Thereafter, the subroutines utilize test data to analyze and display the results of antenna testing.

Figure 4:
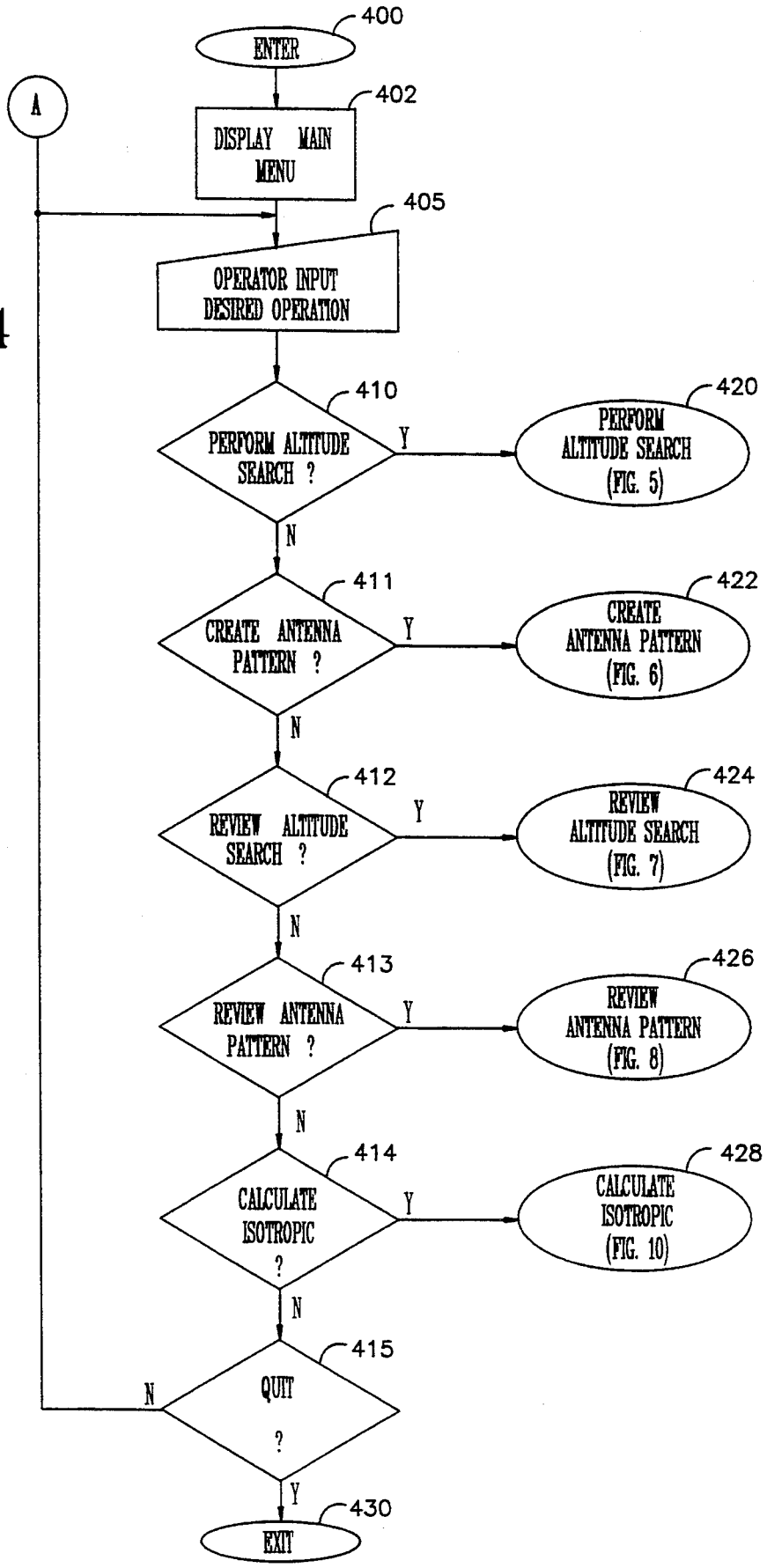
FIG. 4 is a logic flow diagram utilized by the system of FIG. 1 for determining the tests to be performed on a test antenna.

The subroutine of FIG. 4 corresponds to an initial or main menu wherein the test operator may select a particular test or other operation to be performed by the test system. Depending upon the selection made by the test operator in the main menu of the subroutine of FIG. 4, one of the other subroutines illustrated in FIGS. 5 through 10 will be performed.

Figure 5:
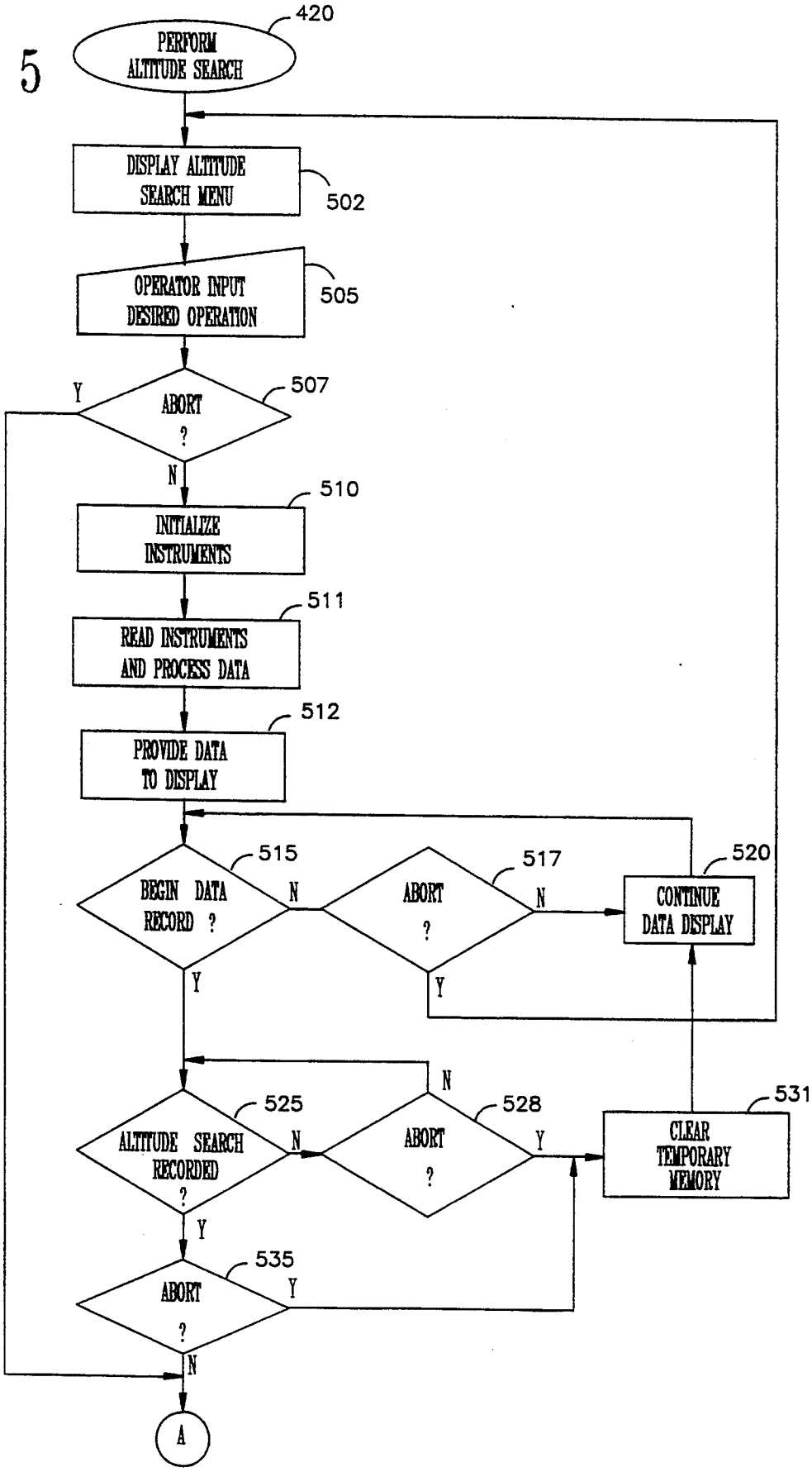
FIG. 5 is a logic flow diagram utilized by the system of FIG. 1 for performing an Altitude Search.
Figure 6:
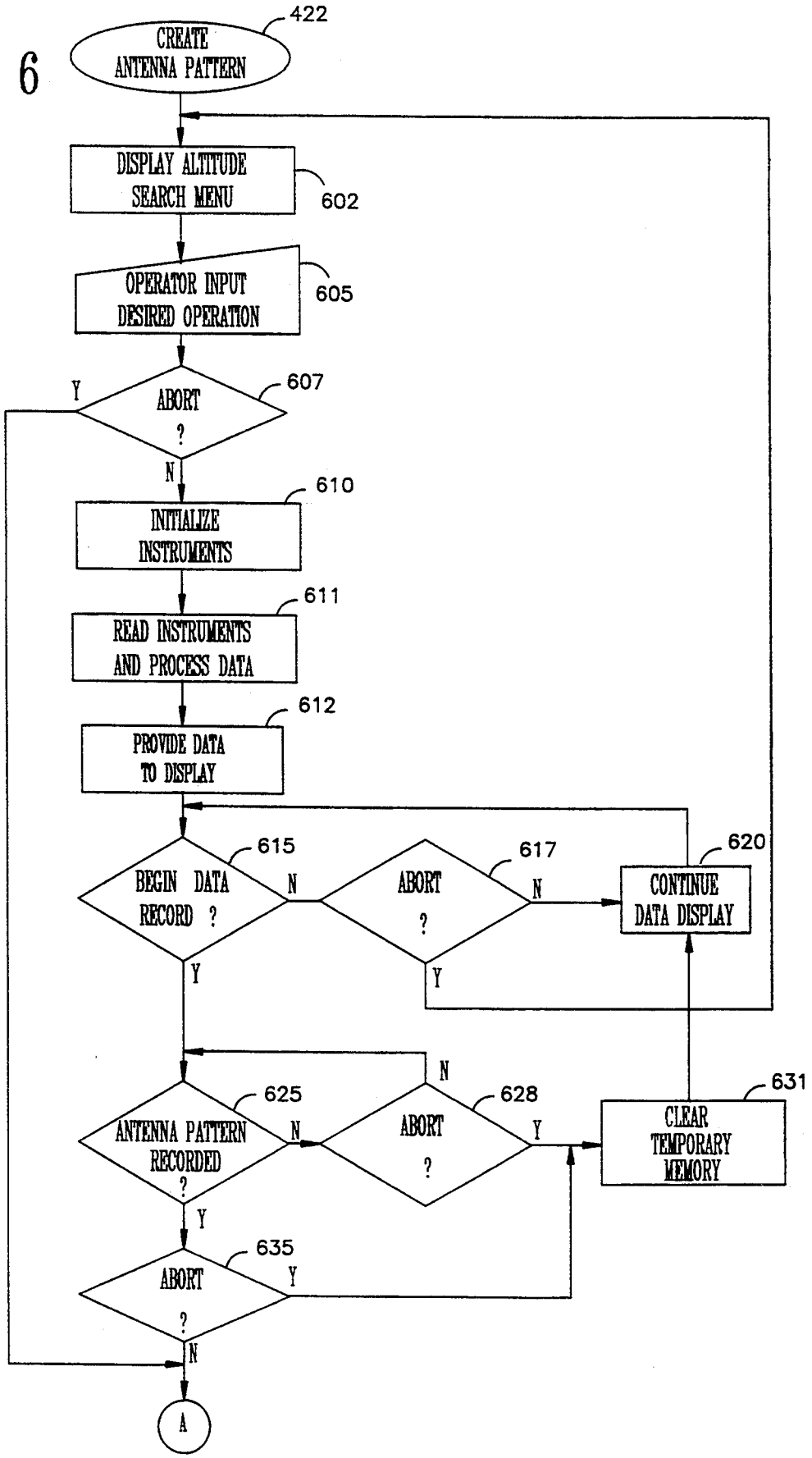
FIG. 6 is a logic flow diagram utilized by the system of FIG. 1 for performing an Antenna Pattern Test.
Figure 7:
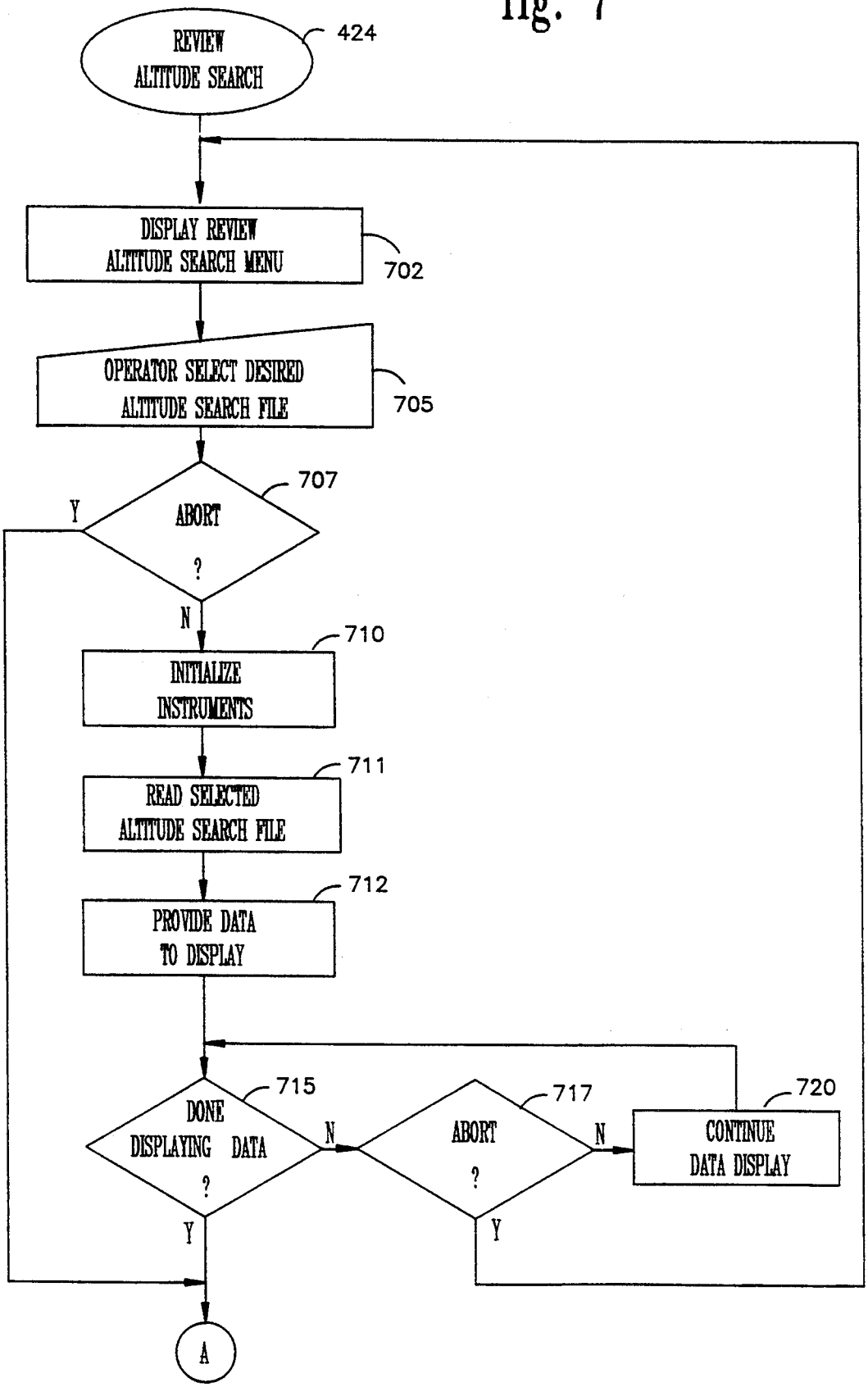
FIG. 7 is a logic flow diagram utilized by the system of FIG. 1 for reviewing an Altitude Search.
Figure 8:
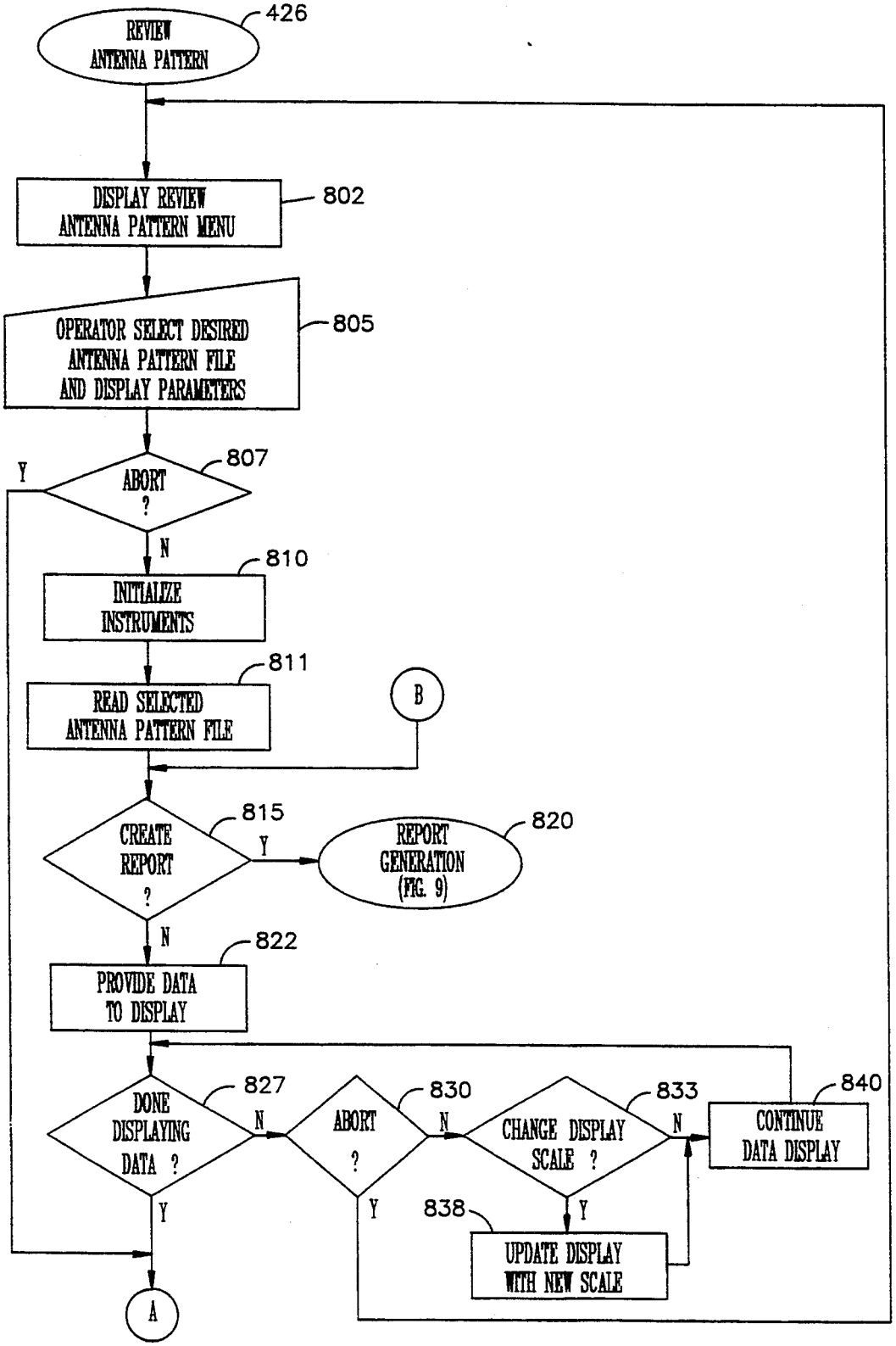
FIG. 8 is a logic flow diagram utilized by the system of FIG. 1 for reviewing an Antenna Pattern Test.
Figure 10:
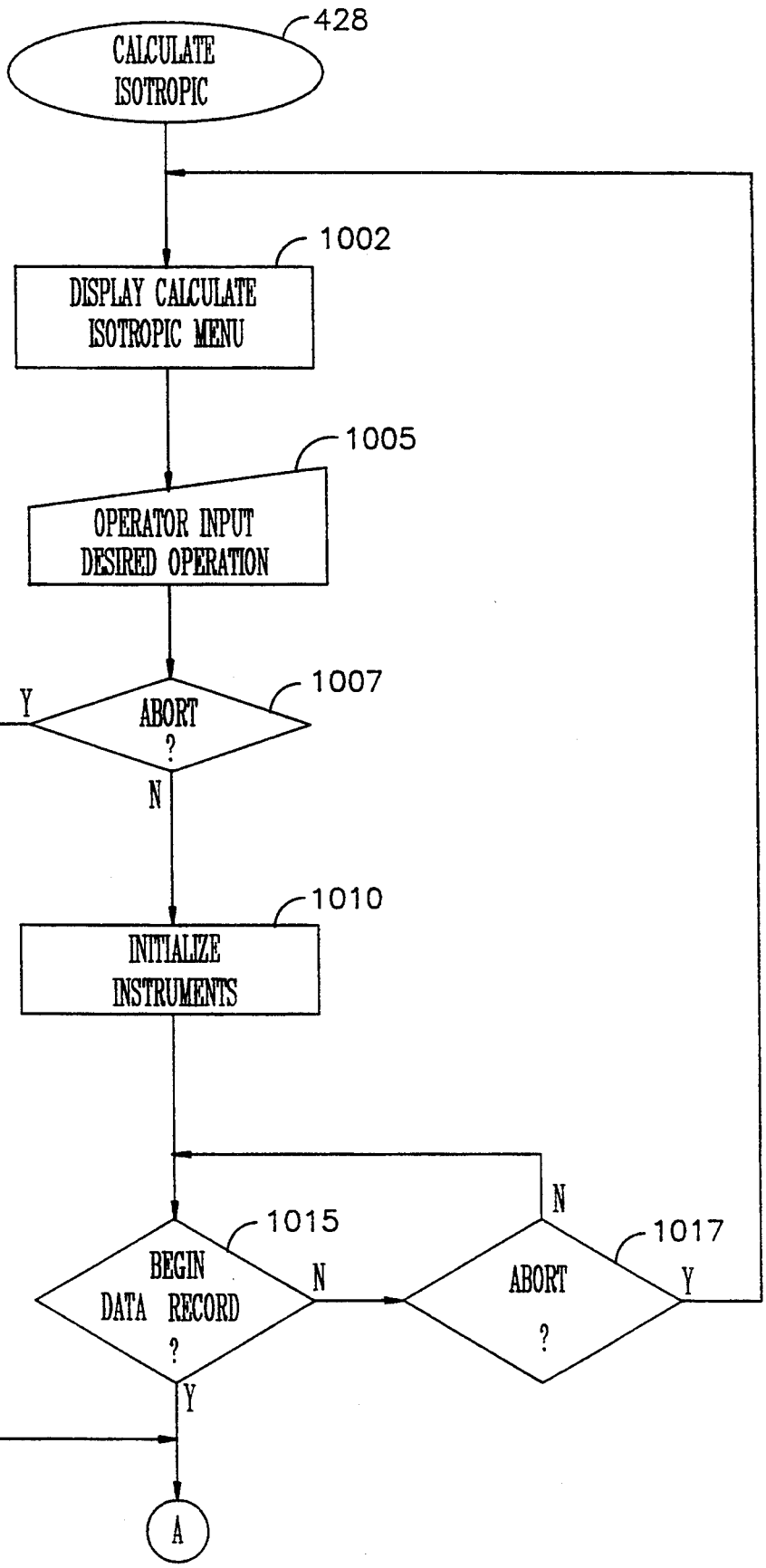
FIG. 10 is a logic flow diagram utilized by the system of FIG. 1 for an antenna Isotropic Calculation.

Referring to FIG. 4, when the system is activated, the subroutine is entered in a step 400, and then the UPROC performs a step 402 wherein a main menu is displayed to provide the test operator with various operation choices. The operation choices include the following selections: Perform Altitude Search; Create Antenna Pattern; Review Altitude Search; Review Antenna Pattern; Calculate Isotropic, and Exit test routine. Next, the UPROC receives the desired test selection input from the test operator in a step 405. Tests 410 through 415 are then sequentially performed to determine which of the desired operations was selected by the test operator. In test 410, the UPROC checks if an Altitude Search was selected. If the results of the test 410 are positive, a step 420 is performed wherein the Altitude Search subroutine of FIG. 5 is performed. If the results of the test 410 are negative, a test 411 is performed wherein the UPROC checks if an Antenna Pattern Test has been selected. If the results of the test 411 are positive a step 422 is performed wherein the Antenna Pattern Test subroutine of FIG. 6 is performed. If the results of the test 411 are negative, a test 412 is performed wherein the UPROC checks if a review of a prior Altitude Search has been selected. If the results of the test 412 are positive, a step 424 is performed wherein the Review Altitude Search subroutine of FIG. 7 is performed. If the results of the test 412 are negative, a test 413 is performed wherein the UPROC checks if the review of an Antenna Pattern Test has been selected. If the results of the test 413 are positive a step 426 is performed wherein the Review Antenna Pattern Test subroutine of FIG. 8 is entered. If the results of the test 413 are negative, a test 414 is performed to determine if the Calculate Isotropic subroutine has been selected. If the results of the test 414 are positive, a step 428 is performed wherein the Calculate Isotropic subroutine of FIG. 10 is entered. If the results of the test 414 are negative, the UPROC performs a test 415 to determine if the test operator has elected to discontinue testing. If the results of the test 415 are negative, no operator input has been provided thus far and the subroutine returns to the step 405. However, if the results of the test 415 are positive, the subroutine exits in a step 430.

Referring now to FIG. 5, if an Altitude Search was selected as determined in the test 410, the subroutine of FIG. 5 is reached in a step 420. Next, a step 502 is performed wherein an Altitude Search menu is is displayed. The Altitude Search menu is presented to the test operator so that various optional and required input parameters may be entered by the test operator. The type of information provided by the test operator includes: the name of the test data file; the location of the antenna on the aircraft; the type of antenna being used; the type of aircraft the antenna is mounted on; the designation of the aircraft; the test frequency; the distance of the aircraft from the portable test section 103 (FIG. 2); the name of the test operator; and any other information that may be useful for performing the Altitude Search. The UPROC then receives the information provided by the test operator in a step 505.

At any point during the test operations, the test operator may press an abort key, e.g., Escape key, to terminate the current step or test operation and return to the previous step or data input screen. Therefore, the UPROC checks in a test 507 if the abort key was depressed prior to commencing the display of Altitude Search information. If the results of the test 507 are positive, the Altitude Search routine is terminated, and the UPROC returns to the main menu of the subroutine of FIG. 4 at "A". If the results of the test 507 are negative, the Altitude Search is commenced, and steps 510 through 512 are consecutively performed. In step 510, all test instruments and displays are initialized, cleared or normalized as required to display the Altitude Search data. In step 511 the telemetered information and the received signal strength data are processed by the UPROC and are provided to the display instruments. In step 512 the processed data is displayed.

The UPROC will continue to only display data and will not begin to record data until the test operator initiates the data recording. Data recording may be initiated by the operator depressing a record button on the CDU, or another suitable method of commencing recording may be provided, such as the pilot on the test aircraft depressing a "Commence Test" button indicating that he has started his assent from the initial altitude to the maximum altitude. In a test 515, the UPROC checks if data recording has been requested. If the results of the test 515 are negative, a test 517 is performed wherein the UPROC checks if the test operator has elected to abort the current test. If the results of the test 517 are positive, the subroutine returns to the step 502. If the results of the test 517 are negative, a step 520 is performed wherein data display is continued, and the subroutine returns to the test 515.

Once data recording has been requested, the results of the test 515 will be positive, and a test 525 is performed wherein the UPROC checks if the Altitude Search recording has been completed. The recording may be indicated as being completed by the aircraft reaching the maximum altitude, or alternatively by the test operator or pilot indicating via a button, switch or other command that the test is complete. If the results of the test 525 are negative, a test 528 is performed wherein the UPROC checks if the test operator has elected to abort the test recording. If the results of the test 528 are positive, the UPROC temporary memory is cleared in a step 531, and the UPROC reaches the step 520 wherein data display is continued. The subroutine then returns to the test 515. If the results of the test 528 are negative, the subroutine returns to the test 525 to determine if the Altitude Search recording is now completed. Once the Altitude Search is completely recorded, the results of the test 525 will be positive, and a test 535 is performed wherein the UPROC checks if the test operator has aborted the completed recording. If the results of the test 535 are positive, the UPROC temporary memory is cleared in step 531, data display is continued in step 520, and then the subroutine returns to the test 515. If the results of the test 535 are negative, the UPROC returns to the subroutine of FIG. 4 at "A".

If the test operator elected to create an Antenna Pattern in the main menu of FIG. 4, the subroutine of FIG. 6 is entered in the step 422. Referring to FIG. 6, a step 602 is next performed wherein an Antenna Pattern Test menu is displayed. The Antenna Pattern Test menu is presented to the test operator so that various optional and required input parameters may be entered by the test operator. The type of information provided by the test operator includes: the name of the test data file; the location of the antenna on the aircraft; the type of antenna being used; the type of aircraft the antenna is mounted on; the designation of the aircraft; the test frequency; the distance of the aircraft from the portable test section 103 (FIG. 2); the altitude at which the test will be performed; the name of the test operator; and any other information that may be useful for performing the Altitude Search. The UPROC then receives the information provided by the test operator in a step 605.

Next, the UPROC checks in a test 607 if the abort key was depressed prior to commencing the display of Antenna Pattern Test information. If the results of the test 607 are positive, the Antenna Pattern Test routine is terminated, and the UPROC returns to the main menu of the subroutine of FIG. 4 at "A". If the results of the test 607 are negative, the Antenna Pattern Test is commenced, and steps 610 through 612 are consecutively performed. In step 610, all test instruments and displays are initialized, cleared or normalized as required to display the Antenna Pattern Test data. In step 611 the telemetered information and the received signal strength data are processed by the UPROC and are provided to the display instruments. In step 512 the processed data is displayed.

The UPROC will continue to only display data and will not begin to record data until the test operator initiates the data recording. In a test 615, the UPROC checks if data recording has been requested. If the results of the test 615 are negative, a test 617 is performed wherein the UPROC checks if the test operator has elected to abort the current test. If the results of the test 617 are positive, the subroutine returns to the step 602. If the results of the test 617 are negative, a step 620 is performed wherein data display is continued, and the subroutine returns to the test 615.

Once data recording has been requested, the results of the test 615 will be positive, and a test 625 is performed wherein the UPROC checks if the Antenna Pattern Test recording has been completed. The recording may be indicated as being completed by the aircraft completing a 360 degree turn, or alternatively by the test operator or pilot indicating via a button, switch or other command that the test is complete. If the results of the test 625 are negative, a test 628 is performed wherein the UPROC checks if the test operator has elected to abort the test recording. If the results of the test 628 are positive, the UPROC temporary memory is cleared in a step 631, and the UPROC reaches the step 620 wherein data display is continued. The subroutine then returns to the test 615. If the results of the test 628 are negative, the subroutine returns to the test 625 to determine if the Antenna Pattern Test recording is now completed. Once the Antenna Pattern Test is completely recorded, the results of the is test 625 will be positive, and a test 635 is performed wherein the UPROC checks if the test operator has aborted the completed recording. If the results of the test 635 are positive, the UPROC temporary memory is cleared in step 631, data display is continued in step 620, and then the subroutine returns to the test 615. If the results of the test 635 are negative, the UPROC returns to the subroutine of FIG. 4 at "A".

Referring now to FIG. 7, if the test operator elected to review a previously recorded Altitude Search, the subroutine of FIG. 7 is entered in the step 424. Next, a step 702 is performed wherein a Review Altitude Search menu is displayed. The Review Altitude Search menu is provided so that the test operator may elect the specific files and parameters associated with Altitude Search review. In particular, the test operator must input the specific Altitude Search file to be reviewed and additionally, the specific type of display to be used for the review must be selected. The UPROC receives the information provided by the test operator in a step 705, and then a test 707 is performed wherein the UPROC checks if the test operator has elected to abort the review of the Altitude Search. If the results of the test 707 are positive, the UPROC returns to the subroutine of FIG. 4 at "A". If the results of the test 707 are negative, steps 710 through 712 are consecutively performed to begin the display of the selected Altitude Search file. In step 710, the display instruments are initialized, cleared, normalized or otherwise made ready to display the selected file. In step 711, the selected Altitude Search file is located on the primary data storage device, and the file is read into the UPROC temporary memory. Then, in step 712, the data from the selected file is provided to the displays.

Next, a test 715 is performed wherein the UPROC checks if all of the data from the selected file has been displayed. If the results from the test 715 are negative, a test 717 is performed wherein the UPROC checks if the test operator has elected to abort the current procedure. If the results of the test 717 are positive, the subroutine returns to the step 702. If the results of the test 717 are negative, step 720 is performed wherein the UPROC continues to display the selected data file, and the subroutine returns to the test 715. Once the selected data file has been completely displayed, the results of the test 715 will be positive and the UPROC returns to the subroutine of FIG. 4 at "A".

Referring now to FIG. 8, if the test operator elected to review a previously recorded Antenna Pattern Test, the subroutine of FIG. 8 is entered in the step 426. Next, a step 802 is performed wherein a Review Antenna Pattern Test menu is displayed. The Review Antenna Pattern Test menu is displayed on the CDU so that the test operator may select the desired Antenna Pattern Test file to review, and so that he may also select the displayed parameters and type of display to be used to display the Antenna Pattern Test file. The UPROC receives the test operator information in a step 805, and then a test 807 is performed wherein the UPROC checks if the test operator has elected to abort the current procedure. If the results of the test 807 are positive, the UPROC returns to the subroutine of FIG. 4 at "A". If the results of the test 807 are negative, a step 810 is performed wherein the display instruments are initialized, cleared, normalized or otherwise made ready to display the selected file. Next, the UPROC retrieves the selected Antenna Pattern Test file from the primary data storage device, and the selected file is read into the UPROC temporary memory.

Figure 9:
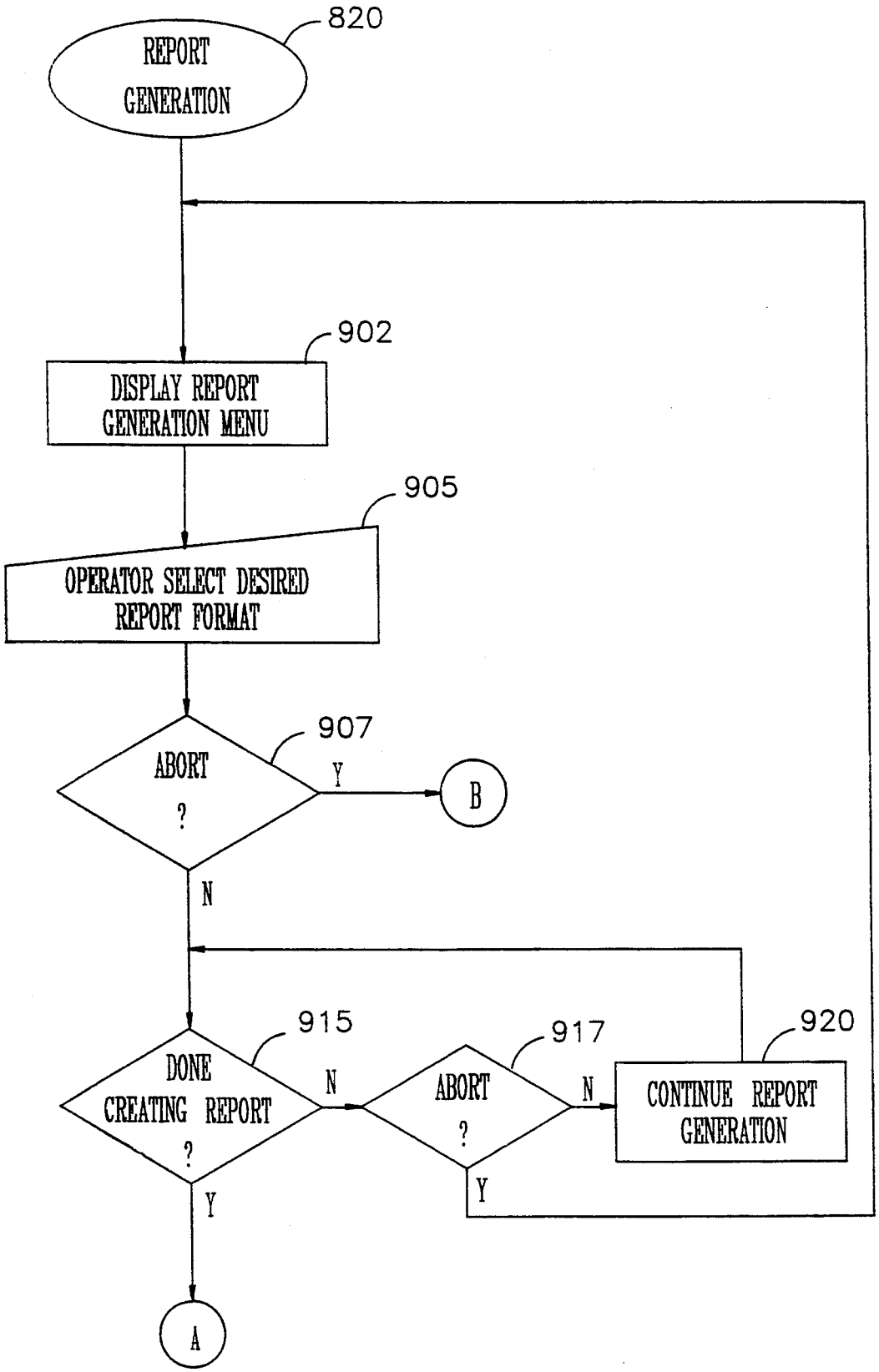
FIG. 9 is a logic flow diagram utilized by the system of FIG. 1 for generating a report of an Antenna Pattern Test.

A test 815 is then performed wherein the UPROC checks if the test operator has elected to create a report. If the results of the test 815 are positive, a Report Generation subroutine of FIG. 9 is entered in a step 820. If the results of the test 815 are negative, a step 822 is performed wherein the Antenna Pattern Test data is provided to the CDU displays. Next, a test 827 is performed, wherein the UPROC checks if the Antenna Pattern Test data has been completely displayed. If the results of the test 827 are negative, a test 830 is performed wherein the UPROC checks if the test operator has elected to abort the current procedure. If the results of the test 830 are positive, the subroutine returns to the step 802. If the results of the test 830 are negative the UPROC performs a test 833 to determine if the test operator has elected to change the display scale. If the results of the test 833 are positive, a step 838 is performed wherein the display scale used to display the Antenna Pattern Test data is updated with a new scale. Next, a step 840 is performed wherein the UPROC continues to display the test data. The step 840 is also reached if the results of the test 833 are negative. The subroutine then returns to the step 827. Once all of the Antenna Pattern Test data has been completely displayed, the results of the test 827 will be positive, and the UPROC returns to the subroutine of FIG. 4 at "A".

If the test operator elected to create a report based on the review of an Antenna Pattern Test, the subroutine of FIG. 9 is entered at the step 820. Next, a step 902 is performed wherein a Report Generation menu is displayed. The Report Generation menu is displayed so that the test operator may elect the specific report format to be used to display/print the test data. The UPROC receives the information from the test operator in a step 905, and then a test 907 is performed wherein the UPROC checks if the test operator has elected to abort the current procedure. If the results of the test 907 are positive, the UPROC returns to the subroutine of FIG. 8 at "B". If the results of the test 907 are negative, a test 915 is performed wherein the UPROC checks if all of the report generation is complete. If the results from the test 915 are negative, a test 917 is performed wherein the UPROC checks if the test operator has elected to abort the current procedure. If the results of the test 917 are positive, the subroutine returns to the step 902. If the results of the test 917 are negative, step 920 is performed wherein the UPROC continues the report generation, and the subroutine returns to the test 915. Once the report generation is complete, the results of the test 915 will be positive and the UPROC returns to the subroutine of FIG. 4 at "A".

The Calculate Isotropic subroutine is used to compare the transmitted power of the test antenna, as received by the portable test section record antenna 171, to theoretical performance criteria. The theoretical performance criteria is determined based on the power transmitted into the test antenna by the transmitter, the theoretical losses in the cabling between the test antenna and the transmitter, the theoretical losses during transmission through the air, and any loses associated with the portable test section 103. If the test operator elected to Calculate Isotropic in the main menu of FIG. 4, the subroutine of FIG. 10 is entered in the step 428. Referring to FIG. 10, a step 1002 is next performed wherein a Calculate Isotropic menu is displayed. The Calculate Isotropic menu is presented to the test operator so that various optional and required input parameters may be entered by the test operator. The type of information provided by the test operator includes: the name of the test data file; the location of the antenna on the aircraft; the type of antenna being used; the type of aircraft the antenna is mounted on; the designation of the aircraft; the test frequency; the distance of the aircraft from the portable test section 103 (FIG. 2); the name of the test operator; aircraft altitude; and any other information that may be useful for performing the Isotropic. The transmission characteristics of RF energy, e.g., expected losses due to absorption and canceling, are affected by the characteristics of the surface the RF energy is traveling over. Therefore, another important parameter utilized by the Calculate Isotropic subroutine is a numerical value related to the type of surface the aircraft is flying over, e.g., salt water, marsh, dirt, asphalt, etc. The number may be directly provided by the test operator, or a look up table may be provided so that the test operator may select a surface type from a menu or table, and thereafter the corresponding number is provided from the look-up table. The UPROC receives the information provided by the test operator in a step 605.

Next, the UPROC checks in a test 1007 if the abort key was depressed prior to commencing the isotropic calculation. If the results of the test 1007 are positive, the Calculate Isotropic routine is terminated, and the UPROC returns to the main menu of the subroutine of FIG. 4 at "A". If the results of the test 1007 are negative, the isotropic calculation is commenced, and step 1010 is performed wherein the isotropic display is initialized.

Next, a test 1015 is performed wherein the UPROC checks if the isotropic calculation is complete, and the isotropic level has been displayed. If the results of the test 1015 are negative, a test 1017 is performed wherein the UPROC checks if the test operator has elected to abort the current test. If the results of the test 1017 are positive, the subroutine returns to the step 1002. If the results of the test 1017 are negative, the subroutine returns to the test 1015. Once the isotropic calculation is complete and the isotropic value is displayed, the results of the test 1015 will be positive, and the UPROC returns to the subroutine of FIG. 4 at "A".

As will be apparent to those skilled in the art, a variety of displays may be used to display an Antenna Pattern Test including a polar plot or a linear plot. Vehicle state parameters may de displayed on a linear scale versus time, or an instantaneous digital or analog meter reading may be provided. The particular state parameters used during a test will depend on the type of vehicle carrying the antenna. For example, altitude is only of significance when testing an antenna mounted on an airborne vehicle, and is irrelevant when testing a land borne or waterborne vehicle.

Although the invention has been described and illustrated with respect to exemplary embodiments thereof, it should be understood by those skilled in the art that the foregoing and various other changes, omissions and additions may be made therein and thereto, without departing from the spirit and scope of the present invention.

We claim:

1. An antenna test and measurement system for measuring the antenna pattern of a vehicle mounted test antenna configured for either transmitting RF signals provided by a transmitter or receiving RF signals and thereafter providing the received RF signals to a receiver, the system comprising:

a vehicle mounted test section having:

means for measuring RF power being transmitted into or being received by the test antenna, and for providing power level signals indicative thereof;

means responsive to signals indicative of aircraft attitude and position for providing vehicle state signals indicative thereof; and vehicle mounted telemetry means responsive to said power level signals and said vehicle state signals for transmitting encoded signals indicative thereof;

a portable test section having:

means for receiving RF signals transmitted by the test antenna and for transmitting RF test signals for receipt by the test antenna;

analysis means connected to said means for receiving for providing antenna pattern signals indicative of the frequency and amplitude of signals received by said means for receiving;

portable telemetry means for receiving said encoded signals transmitted by said telemetry means; and signal processing means responsive to said encoded signals and said antenna pattern signals for creating correlated, time sequenced records of said encoded signals and said antenna pattern signals.

2. An antenna test and measurement system according to claim 1 further comprising memory means for storing said correlated, time sequenced records.

3. An antenna test and measurement system according to claim 1 wherein said vehicle mounted test section further comprising pulse code modulating means responsive to said power level signals and said vehicle state signals for providing digital, encoded signals indicative thereof, and wherein said vehicle mounted telemetry means comprises a vehicle mounted telemetry transmitter for transmitting said digital, encoded signals via a vehicle mounted telemetry antenna.

4. An antenna test and measurement system according to claim 3 wherein said portable telemetry means further comprises:

at least one portable telemetry antenna for receiving said digital, encoded signals;

portable telemetry receiver means connected for communication with said portable telemetry antenna for receiving and decoding said digital, encoded signals to provide received power level signals and received vehicle state signals to said signal processing means.

5. An antenna test and measurement system according to claim 1 wherein said means for measuring RF power comprises:

a watt meter element mounted on said test antenna for providing signals indicative of the power level of RF signals transmitted into or received by said test antenna; and a watt meter responsive to signals provided by said watt meter element for providing said power level signals.

6. An antenna test and measurement system according to claim 1 wherein said portable test section further comprises display means for providing a visual display of said antenna pattern, said power level and said vehicle state signals.

7. An antenna test and measurement system according to claim 1 wherein said portable test section further comprises operator input means responsive to signals provided by a test operator for controlling the operation of said system.

8. An antenna test and measurement system according to claim 1 wherein said signal processing means is further responsive to said antenna pattern signals and said encoded signals for generating a corrected antenna pattern signal indicative of the antenna pattern had any variations in vehicle state not occurred.

9. An antenna test and measurement system according to claim 2 wherein said portable test section further comprises display means for providing a visual display of said antenna pattern, said power level and said vehicle state signals.

10. An antenna test and measurement system according to claim 9 wherein said portable test section further comprises operator input means responsive to signals provided by a test operator for controlling the operation of said system.

11. An antenna test and measurement system according to claim 10 wherein said signal processing means is responsive to a playback signal provided by said operator input means for displaying one of said correlated, time sequenced records stored by said memory means.

12. An antenna test and measurement system according to claim 4 wherein said portable test section further comprises operator input means responsive to signals provided by a test operator for controlling the operation of said system, wherein said portable telemetry means further comprises a portable telemetry transmitter for transmitting duplex command signals provided by said operator input means via said portable telemetry antenna, and wherein said vehicle mounted test section further comprises a vehicle mounted telemetry receiver for receiving said transmitted duplex command signals via said vehicle mounted telemetry antenna.

* * * * *